US008124007B2

(12) United States Patent
Menon et al.

(10) Patent No.: US 8,124,007 B2
(45) Date of Patent: Feb. 28, 2012

(54) STAINLESS STEEL WELD OVERLAYS WITH ENHANCED WEAR RESISTANCE

(75) Inventors: Ravi Menon, Goodlettsville, TN (US); Jack Garry Wallin, Scottsville, KY (US); Francis Louis LeClaire, Bowling Green, KY (US)

(73) Assignee: Stoody Company, Bowling Green, KY (US)

( * ) Notice: Subject to any disclaimer, the term of this patent is extended or adjusted under 35 U.S.C. 154(b) by 360 days.

(21) Appl. No.: 11/356,270

(22) Filed: Feb. 16, 2006

(65) Prior Publication Data

US 2007/0187458 A1 Aug. 16, 2007

(51) Int. Cl.
*C22C 38/26* (2006.01)
*C22C 38/28* (2006.01)
*B23K 35/22* (2006.01)

(52) U.S. Cl. ..... 420/55; 148/325; 148/326

(58) Field of Classification Search ..... 75/302; 148/325, 326, 542; 219/76.1; 228/111; 420/34, 420/43, 55, 56, 57, 67, 68, 69, 70, 99, 101, 420/119, 123, 124, 126, 127
See application file for complete search history.

(56) References Cited

U.S. PATENT DOCUMENTS

| | | | | |
|---|---|---|---|---|
| 2,789,049 | A | 4/1957 | De Long et al. | |
| 3,437,478 | A | 4/1969 | Moskowitz et al. | |
| 3,859,147 | A * | 1/1975 | Philip | 420/69 |
| 3,967,036 | A | 6/1976 | Sadowski | |
| 4,041,274 | A | 8/1977 | Sadowski | |
| 4,431,447 | A | 2/1984 | Schick | |
| 4,472,619 | A * | 9/1984 | Ueda et al. | 219/76.15 |
| 4,487,630 | A * | 12/1984 | Crook et al. | 420/36 |
| 4,556,607 | A * | 12/1985 | Sastri | 428/627 |
| 4,880,481 | A * | 11/1989 | Jerlich et al. | 148/325 |
| 4,888,153 | A * | 12/1989 | Yabuki et al. | 420/57 |
| 5,458,703 | A * | 10/1995 | Nakai | 148/503 |
| 5,514,328 | A * | 5/1996 | Menon et al. | 420/36 |
| 5,704,765 | A | 1/1998 | Amos et al. | |
| 6,375,764 | B1 * | 4/2002 | Ito et al. | 148/326 |
| 6,702,905 | B1 * | 3/2004 | Qiao et al. | 148/326 |
| 6,761,777 | B1 * | 7/2004 | Radon | 148/325 |
| 2003/0188808 | A1 * | 10/2003 | Ueta et al. | 148/327 |
| 2006/0165551 | A1 * | 7/2006 | Kapoor et al. | 420/69 |
| 2007/0187369 | A1 * | 8/2007 | Menon et al. | 219/76.1 |
| 2008/0274006 | A1 * | 11/2008 | Bright et al. | 420/17 |

FOREIGN PATENT DOCUMENTS

DE 2754437 * 7/1979

(Continued)

OTHER PUBLICATIONS

Stoody Hardfacing Guide: Accessed Aug. 19th, 2008.*

(Continued)

*Primary Examiner* — George Wyszomierski
*Assistant Examiner* — Mark L Shevin
(74) *Attorney, Agent, or Firm* — Brinks Hofer Gilson & Lione

(57) ABSTRACT

Compositions for stainless steel weld overlays having enhanced wear resistance are provided by incorporating second phase Titanium Carbide (TiC) and/or Niobium Carbide (NbC) into matrices of various types of stainless steel such as 316L and 420. Preferably, TiC and NbC precipitates are formed in-situ during the weld overlay process while minimizing the amount of Carbon (C) going into solid solution in the matrix of the weld overlay.

29 Claims, 4 Drawing Sheets

FOREIGN PATENT DOCUMENTS

| | | | |
|---|---|---|---|
| GB | 741935 | A | 12/1955 |
| GB | 2041810 | A | 9/1980 |
| JP | 53-050007 | * | 5/1978 |
| JP | 55-014171 | A | 1/1980 |
| JP | 56-152945 | * | 11/1981 |
| JP | 58-086974 | * | 5/1983 |
| JP | 58-086974 | A | 5/1983 |
| JP | 59-076696 | | 5/1984 |
| JP | 09-249947 | | 9/1997 |
| JP | 2001-234278 | * | 8/2001 |

OTHER PUBLICATIONS

J. Truhan et al. The friction and wear of various hard-face claddings for deep-hole drilling. Wear vol. 263, (2007), p. 234-239.*

B.G. Mellor. Welding surface treatment methods for protection against wear. Chapter 9, In, B.G. Mellor (ed.) Surface Coatings for Protection Against Wear. Cambridge, UK, Woodhead Publishing Limited, (2006), 42 pages.*

English translation of Hiraoka—JP 59-076696, Published May 1984.*

English translation of JP 58-086974 to Kiyoshi Yokoi, published May 24, 1983, 18 pages total.*

International Search Report for PCT/US2007/003711, Published May 28, 2008.

International Search Report for PCT/US2007/003711, Jul. 17, 2008.

* cited by examiner

STAINLESS STEEL WELD OVERLAYS WITH ENHANCED WEAR RESISTANCE

FIELD

The present disclosure relates to alloy compositions for arc welding and more particularly to stainless steel weld overlay compositions with enhanced wear resistance.

BACKGROUND

The statements in this section merely provide background information related to the present disclosure and may not constitute prior art.

Industrial components are often subjected to operational and environmental conditions that require good corrosion and wear resistance. Examples of such industrial components and their applications include piping, process equipment, and mixing equipment, among others. These industrial components often include a stainless steel weld overlay to improve the corrosion resistance.

Although stainless steels provide adequate corrosion resistance, their abrasion resistance is relatively poor. In fact, for austenitic stainless steels of the 304 type (hardness HRC 25-35), the abrasion resistance as measured by the ASTM G65 test is lower than that of a plain carbon steel. The martensitic stainless steels of the 410/420 type have somewhat better wear resistance as they are typically at hardness levels of HRC 40-50. Hardened low alloy steels (HRC 50-55) have significantly better wear resistance. These wear comparisons are shown in FIG. 1.

SUMMARY

Compositions for stainless steel weld overlays having enhanced wear resistance are provided by incorporating second phase titanium Carbide (TiC) and/or niobium Carbide (NbC) into matrices of various types of stainless steel such as 316L and 420. Preferably, TiC and NbC precipitates are formed in-situ during the weld overlay process while minimizing the amount of Carbon (C) going into solid solution in the matrix of the weld overlay. The alloys of the present disclosure have increased abrasion resistance due to the incorporation of second phase carbides of the TiC and NbC type. The incorporation of these phases results in significantly enhanced wear resistance.

In one form, a stainless steel weld overlay composition of the 316L type is provided that comprises, by percent mass between approximately 0.5% and approximately 1.5% Carbon, between approximately 0.1% and approximately 2.0% Manganese, between approximately 0.1% and approximately 0.9% Silicon, between approximately 14.0% and approximately 18.0% Chromium, between approximately 6.0% and approximately 10.0% Nickel, between approximately 1.5% and approximately 3.5% Molybdenum, between approximately 0.5% and approximately 8.0% Titanium and Niobium, and less than approximately 0.15% Nitrogen. In additional forms, the Carbon comprises approximately 1.0%, the Manganese comprises approximately 1.3%, the Silicon comprises approximately 0.5%, the Chromium comprises approximately 16.0%, the Nickel comprises approximately 8.0%, the Molybdenum comprises approximately 2.5%, the Titanium and Niobium comprise approximately 6.1%, and the Nitrogen comprises approximately 0.1%.

In another form, a stainless steel weld overlay composition of the 420 type is provided that comprises, by percent mass, between approximately 0.5% and approximately 1.5% Carbon, between approximately 0.1% and approximately 2.0% Manganese, between approximately 0.1% and approximately 0.9% Silicon, between approximately 12.0% and approximately 18.0% Chromium, between approximately 0.1% and approximately 1.8% Molybdenum, between approximately 0.5% and approximately 8.0% Titanium and Niobium, less than approximately 0.15% Nitrogen, and between approximately 0.15% and approximately 2.0% Vanadium. In additional forms, the Carbon comprises approximately 1.1%, the Manganese comprises approximately 0.75%, the Silicon comprises approximately 0.5%, the Chromium comprises approximately 14.5%, the Molybdenum comprises approximately 0.5%, the Titanium and Niobium comprise approximately 6.1%, the Nitrogen comprises approximately 0.1%, and the Vanadium comprises approximately 0.4%.

In yet another form, a stainless steel weld overlay composition of the 420 type is provided that comprises, by percent mass, between approximately 0.1% and approximately 1.0% Carbon, between approximately 0.1% and approximately 2.0% Manganese, between approximately 0.1% and approximately 1.5% Silicon, between approximately 11.0% and approximately 18.0% Chromium, less than approximately 6.0% Nickel, between approximately 0.1% and approximately 2.5% Molybdenum, between approximately 0.5% and approximately 8.0% Titanium and Niobium, less than approximately 0.15% Nitrogen, and between approximately 0.05% and approximately 2.0% Vanadium. In additional forms, the Carbon comprises approximately 0.5%, the Manganese comprises approximately 0.7%, the Silicon comprises approximately 0.7%, the Chromium comprises approximately 13.0%, the Nickel comprises approximately 3.0%, the Molybdenum comprises approximately 1.3%, the Titanium and Niobium comprise approximately 2.2%, the Nitrogen comprises approximately 0.1%, and the Vanadium comprises approximately 0.4%.

According to a method provided herein, a stainless steel weld overlay is formed by producing precipitates selected from the group consisting of Titanium Carbide and Niobium Carbide in-situ during a weld overlay process.

DRAWINGS

The drawings described herein are for illustration purposes only and are not intended to limit the scope of the present disclosure in any way.

Figure 3A:
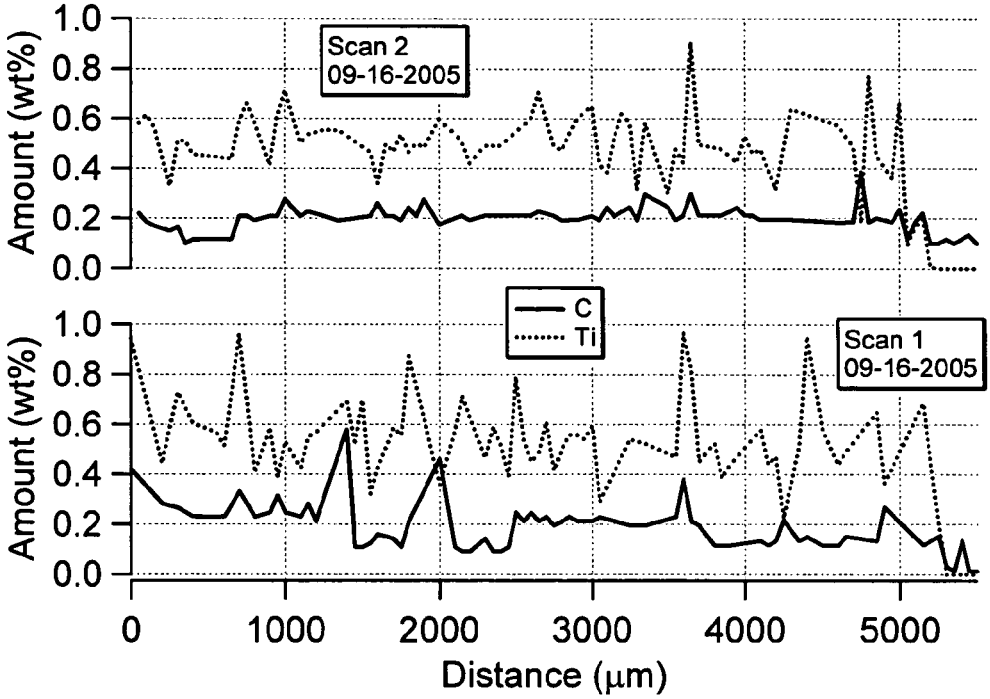
Figure 3B:
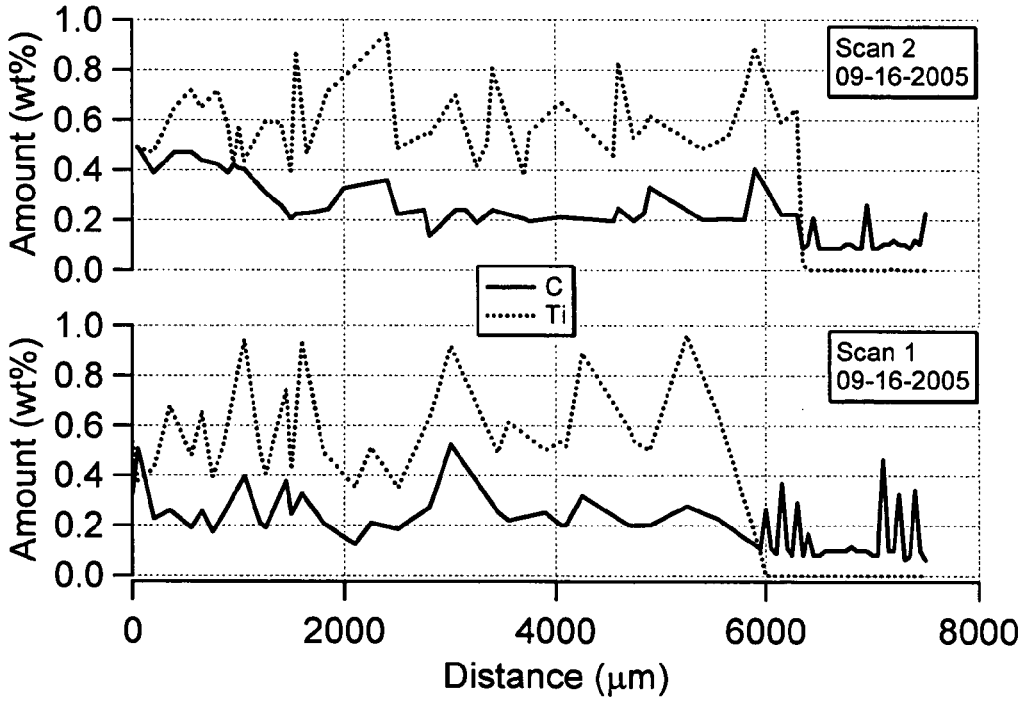
Figure 4A:
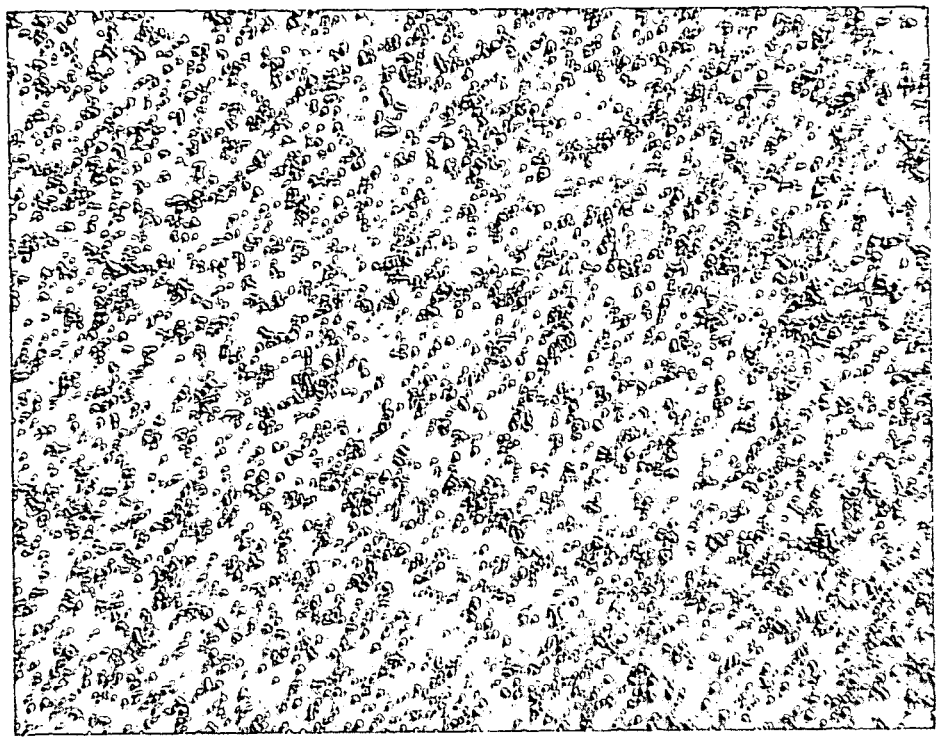
Figure 4B:
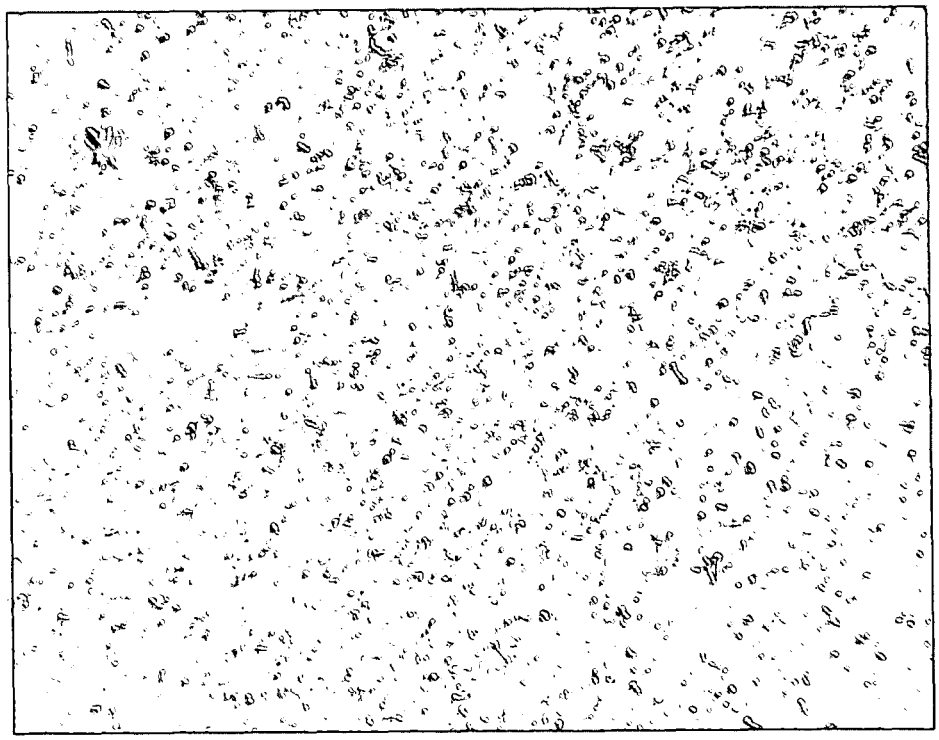

FIG. 3*a* is an electron microprobe scan of 316Ti/NbC in accordance with the teachings of the present disclosure;

FIG. 3*b* is an electron microprobe scan of 420Ti/NbC in accordance with the teachings of the present disclosure;

FIG. 4*a* is a photomicrograph illustrating the microstructure of 316Ti/NbC in accordance with the teachings of the present disclosure; and FIG. 4*b* is a photomicrograph illustrating the microstructure of 420Ti/NbC in accordance with the teachings of the present disclosure.

DETAILED DESCRIPTION

The following description is merely exemplary in nature and is not intended to limit the present disclosure, application, or uses. It should be understood that throughout the drawings, corresponding reference numerals indicate like or corresponding parts and features.

Compositions for stainless steel weld overlays having enhanced wear resistance are provided by incorporating second phase Titanium Carbide (TiC) and/or Niobium Carbide (NbC) into matrices of various types of stainless steel such as 316L and 420. Preferably, TiC and NbC precipitates are formed in-situ during the weld overlay process while minimizing the amount of Carbon (C) going into solid solution in the matrix of the weld overlay.

Referring to Table 1 below, three (3) stainless steel weld overlay compositions (including both target percentages and ranges of percent elements by weight) according to the present disclosure are listed as "Overlay A," "Overlay B," and "Overlay C."

TABLE 1

| | 316L Nb/TiC Overlay A Target | 316L Nb/TiC Overlay A Range | 420 NbC/TiC Overlay B Target | 420 NbC/TiC Overlay B Range | 420 NbC/TiC Overlay C Target | 420 NbC/TiC Overlay C Range |
|---|---|---|---|---|---|---|
| Carbon | 1.0 | 0.5-1.5 | 1.1 | 0.5-1.5 | 0.5 | 0.1-1.0 |
| Manganese | 1.3 | 0.1-2.0 | 0.75 | 0.1-2.0 | 0.7 | 0.1-2.0 |
| Silicon | 0.5 | 0.1-0.9 | 0.5 | 0.1-0.9 | 0.7 | 0.1-1.5 |
| Chromium | 16.0 | 14.0-18.0 | 14.5 | 12.0-18.0 | 13.0 | 11.0-18.0 |
| Nickel | 8.0 | 6.0-10.0 | — | — | 3 | 0.0-6.0 |
| Molybdenum | 2.5 | 1.5-3.5 | 0.5 | 0.1-1.8 | 1.3 | 0.1-2.5 |
| Titanium and Niobium | 6.1 | 0.5-8.0 | 6.1 | 0.5-8.0 | 2.2 | 0.5-8.0 |
| Nitrogen | 0.1 | 0.0-0.15 | 0.1 | 0.0-0.15 | 0.1 | 0.0-0.15 |
| Vanadium | — | — | 0.4 | 0.05-2.0 | 0.4 | 0.05-2.0 |

As shown, the composition for Overlay A is of the 316L type of stainless steel, and both Overlay B and Overlay C are of the 420 type of stainless steel. Generally, stainless steel type 316L is an austenitic chromium-nickel stainless steel containing molybdenum. Type 316L is an extra-low carbon version of type 316 that reduces carbide precipitation during welding. Stainless steel type 420 is a martensitic stainless steel with good corrosion resistance, strength, and hardness. Both types of stainless steel are thus well suited for weld overlays to improve wear resistance. Each element and its contribution to properties of the weld deposit are now described in greater detail.

Carbon (C) is an element that improves hardness and strength. The preferred amount of Carbon for both Overlay A and Overlay B is between approximately 0.5 and 1.5 percent, with a target value of approximately 1.0% for Overlay A and 1.1% for Overlay B. The preferred amount of Carbon for Overlay C is between approximately 0.1 percent and 1.0 percent, with a target value of approximately 0.5%. The carbon contents are adjusted so that the amount of carbon left in the matrix after the carbides are formed during the solidification is relatively low. Accordingly, the low carbon in the matrix contributes to improved corrosion resistance.

Manganese (Mn) is an element that improves the strength and hardness and acts as a deoxidizer, in which the deoxidizer also acts as a grain refiner when fine oxides are not floated out of the metal. The preferred amount of manganese for both Overlay A and Overlay B is between approximately 0.1 and 2.0 percent, with a target value of approximately 1.3% for Overlay A and 0.75% for Overlay B. The preferred amount of Manganese for Overlay C is between approximately 0.1 percent and 2.0 percent, with a target value of approximately 0.7%.

Silicon (Si) is an element that acts as a deoxidizer and also as a grain refiner when fine oxides are not floated out of the metal. The preferred amount of Silicon for both Overlay A and Overlay B is between approximately 0.1 and 0.9 percent, with a target value of approximately 0.5%. The preferred amount of Silicon for Overlay C is between approximately 0.1 percent and 1.5 percent, with a target value of approximately 0.7%.

Chromium (Cr) is an element that provides improved hardenability, corrosion resistance, and improved high temperature creep strength. The preferred amount of Chromium for Overlay A is between approximately 14.0 percent and 18.0 percent, with a target value of approximately 16.0%. The preferred amount of Chromium for Overlay B is between approximately 12.0 percent and 18.0 percent, with a target value of approximately 14.5%. The preferred amount of Chromium for Overlay C is between approximately 11 percent and 18.0 percent, with a target value of approximately 13.0%.

Nickel (Ni) is an element that provides improved ductility, which improves resistance to impacts at lower temperatures. Combined with Chromium at high enough percentages, an austenitic stainless steel results. The preferred amount of Nickel for Overlay A is between approximately 6.0 percent and 10.0 percent, with a target value of approximately 8.0%. There is no Nickel in Overlay B, and the preferred amount of Nickel for Overlay C is less than approximately 6.0 percent, with a target value of approximately 3.0%

Molybdenum (Mo) is an element that provides improved corrosion resistance, tensile strength and hardness to the weld overlay. The preferred amount of Molybdenum for Overlay A is between approximately 1.5 percent and 3.5 percent, with a target value of approximately 2.5%. The preferred amount of Molybdenum for Overlay B is between approximately 0.1 percent and 1.8 percent, with a target value of approximately 0.5%. The preferred amount of Molybdenum for Overlay C is between approximately 0.1 percent and 2.5 percent, with a target value of approximately 1.3%.

Titanium (Ti) acts as a grain refiner and as a deoxidizer and is also a part of the Titanium Carbide precipitates that improve wear resistance of the stainless steel weld overlay. Niobium (Nb) acts as a carbide former and is present, along with Titanium, in each of the compositions of Overlay A, Overlay B, and Overlay C. The Niobium is also a part of the Niobium Carbide precipitates that improve wear resistance of the stainless steel weld overlay. The preferred amount of Titanium and Niobium for Overlays A and B is between approximately 0.5 and 8.0 percent with a target value of approximately 6.1%. The preferred amount of Titanium and Niobium for Overlay C is between approximately 0.5 percent and 7.0 percent, with a target value of approximately 2.2%.

Nitrogen (N) is an element that stabilizes the formation of austenitic structures and is thus added to austenitic stainless steel to reduce the amount of Nickel needed, which reduces overall cost. The preferred amount of Nitrogen for each of Overlay A, Overlay B, and Overlay C is less than approximately 0.15 percent, with a target value of approximately 0.1%.

Vanadium (V) is also a grain refiner and thus increases toughness of the weld overlay. Also, Vanadium is present in the compositions of Overlay B and Overlay C. The preferred amount of Vanadium for both Overlay B and Overlay C is between approximately 0.05 percent and 2.0 percent, with a target value of approximately 0.4%.

Figure 1:
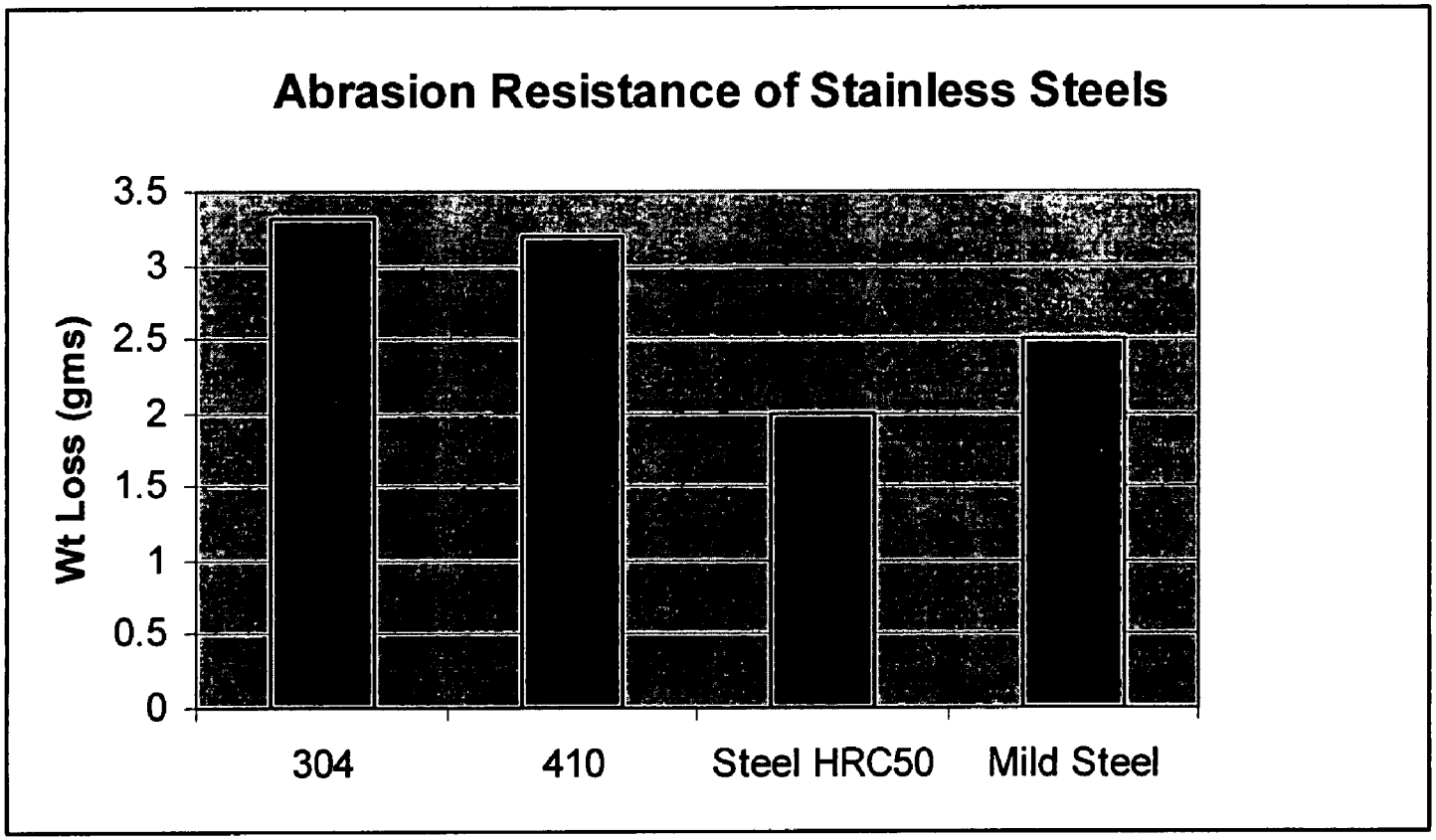
FIG. 1 is a chart illustrating the abrasion resistance of Stainless Steels 304 and 410 compared to Hardened Carbon Steel.
Figure 2:
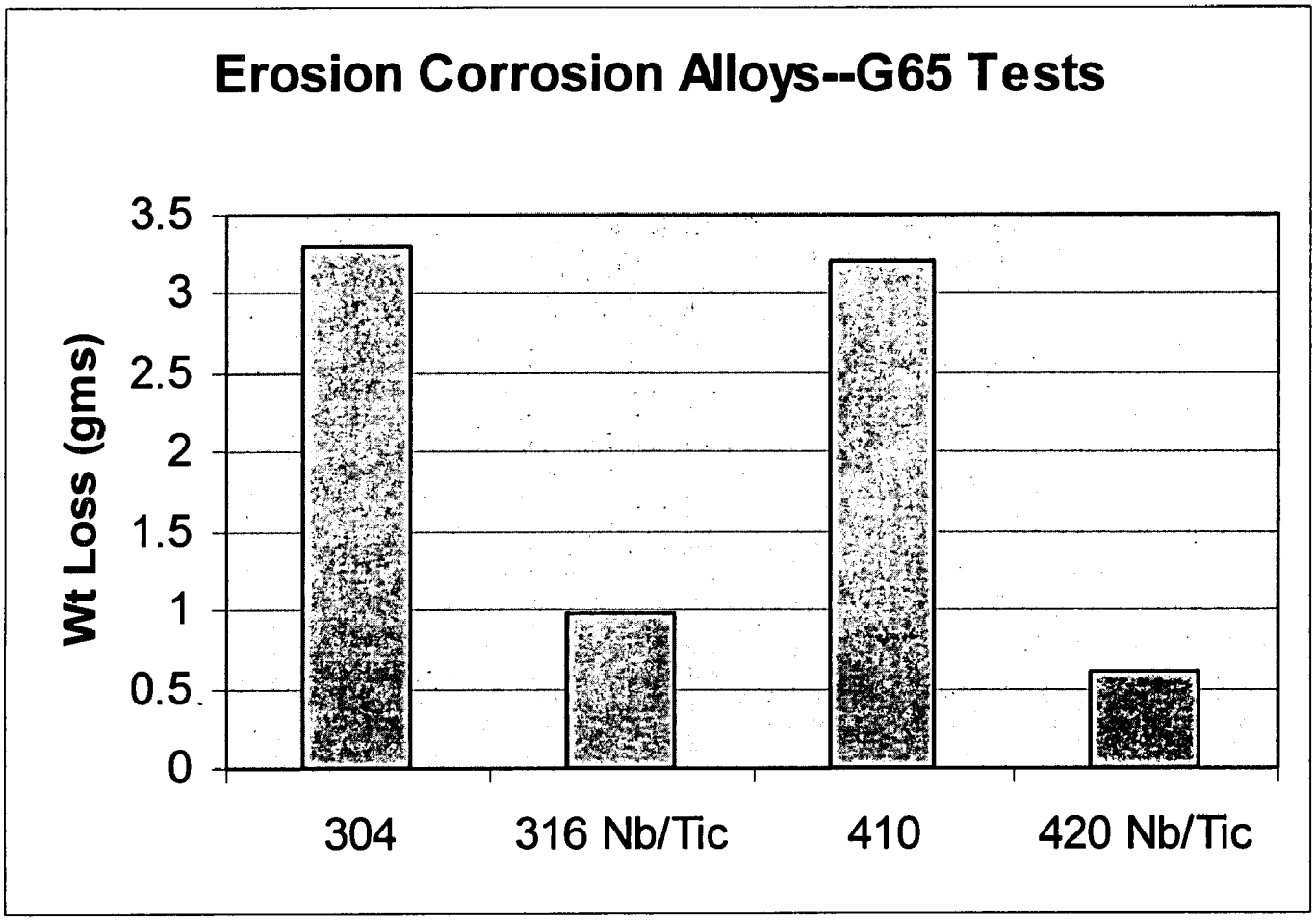
FIG. 2 is a chart illustrating test data from compositions according to the present disclosure that were overlaid on a carbon steel plate and tested per ASTM G65 Procedure A.

Referring now to FIG. 2, compositions according to the present disclosure were overlaid on a carbon steel plate and wear tests per ASTM G65 Procedure A were conducted. The data clearly indicates that the carbide modified stainless steel weld overlays have significantly improved wear resistance over the base stainless steel materials.

As shown in FIGS. 3*a* and 3*b*, the carbon content of the matrix is at or below approximately 0.1% by weight, although the bulk carbon content is approximately 1%. The balance of the carbide is tied up as carbides of the NbC and TiC type, thus providing improved wear resistance. The composition of the overlay wires has been adjusted such that the carbon content of the matrix remains relatively low, which is important to preserve the corrosion resistance of the base materials.

Exemplary microstructures of overlays made according to the teachings of the present disclosure are illustrated in FIGS. 4*a* and 4*b*. As shown, fine precipitates of TiC/NbC are developed, which enhance the wear resistance of the base stainless steels 316L and 420, respectively.

The description of the disclosure is merely exemplary in nature and, thus, variations that do not depart from the gist of the disclosure are intended to be within the scope of the disclosure. For example, the weld deposit according to the teachings of the present disclosure may be produced from welding wire such as flux-core wires, metal-cored wires, or solid wires, while remaining within the scope of the disclosure. Such variations are not to be regarded as a departure from the spirit and scope of the disclosure.

What is claimed is:

1. A stainless steel weld overlay having a matrix with a bulk composition comprising, by percent mass:

between approximately 0.5% and approximately 1.5% Carbon;

between approximately 0.1% and approximately 2.0% Manganese;

between approximately 0.1% and approximately 0.9% Silicon;

between approximately 14.0% and approximately 18.0% Chromium;

between approximately 6.0% and approximately 10.0% Nickel;

between approximately 1.5% and approximately 3.5% Molybdenum; the elements of both Titanium and Niobium in an amount between approximately 0.5% and approximately 8.0%; and greater than 0% and less than approximately 0.15% Nitrogen;

wherein both second phase Titanium Carbide and second phase Niobium Carbide precipitates are incorporated in the stainless steel weld overlay;

wherein the composition is adjusted such that the Carbon content in the matrix is at or below approximately 10% of the bulk Carbon content, the balance being tied up as the carbides of Titanium and Niobium.

2. The stainless steel weld overlay composition according to claim 1, wherein the Carbon comprises approximately 1.0%.

3. The stainless steel weld overlay composition according to claim 1, wherein the Manganese comprises approximately 1.3%.

4. The stainless steel weld overlay composition according to claim 1, wherein the Silicon comprises approximately 0.5%.

5. The stainless steel weld overlay composition according to claim 1, wherein the Chromium comprises approximately 16.0%.

6. The stainless steel weld overlay composition according to claim 1, wherein the Nickel comprises approximately 8.0%.

7. The stainless steel weld overlay composition according to claim 1, wherein the Molybdenum comprises approximately 2.5%.

8. The stainless steel weld overlay composition according to claim 1, wherein the Titanium and the Niobium comprise approximately 6.1%.

9. The stainless steel weld overlay composition according to claim 1, wherein the Nitrogen comprises approximately 0.1%.

10. A stainless steel weld overlay having a matrix with a bulk composition comprising, by percent mass:

between approximately 0.5% and approximately 1.5% Carbon;

between approximately 0.1% and approximately 2.0% Manganese;

between approximately 0.1% and approximately 0.9% Silicon;

between approximately 12.0% and approximately 18.0% Chromium;

between approximately 0.1% and approximately 1.8% Molybdenum;

the elements of both Titanium and Niobium in an amount between approximately 0.5% and approximately 8.0%;

approximately 0.1% Nitrogen; and between approximately 0.05% and approximately 2.0% Vanadium;

wherein both second phase Titanium Carbide and second phase Niobium Carbide precipitates are incorporated in the stainless steel weld overlay;

wherein the composition is adjusted such that the Carbon content in the matrix is at or below approximately 10% of the bulk Carbon content, the balance being tied up as carbides of Titanium and Niobium.

11. The stainless steel weld overlay composition according to claim 10, wherein the Carbon comprises approximately 1.1%.

12. The stainless steel weld overlay composition according to claim 10, wherein the Manganese comprises approximately 0.75%.

13. The stainless steel weld overlay composition according to claim 10, wherein the Silicon comprises approximately 0.5%.

14. The stainless steel weld overlay composition according to claim 10, wherein the Chromium comprises approximately 14.5%.

15. The stainless steel weld overlay composition according to claim 10, wherein the Molybdenum comprises approximately 0.5%.

16. The stainless steel weld overlay composition according to claim 10, wherein the Titanium and the Niobium comprise approximately 6.1%.

17. The stainless steel weld overlay composition according to claim 10, wherein the Vanadium comprises approximately 0.4%.

18. A stainless steel weld overlay having a matrix with a bulk composition comprising, by percent mass:

between approximately 0.5% and approximately 1.0% Carbon;

between approximately 0.1% and approximately 2.0% Manganese;

between approximately 0.1% and approximately 1.5% Silicon;

between approximately 11.0% and approximately 18.0% Chromium;

less than approximately 6.0% Nickel;

between approximately 0.1% and approximately 2.5% Molybdenum;

the elements of both Titanium and Niobium in an amount between approximately 0.5% and approximately 8.0%;

approximately 0.1% Nitrogen; and between approximately 0.05% and approximately 2.0% Vanadium;

wherein both second phase Titanium Carbide and second phase Niobium Carbide precipitates are incorporated in the stainless steel;

wherein the composition is adjusted such that the Carbon content in the matrix is at or below approximately 10% of the bulk Carbon content, the balance being tied up as carbides of Titanium and Niobium.

19. The stainless steel weld overlay composition according to claim 18, wherein the Carbon comprises approximately 0.5%.

20. The stainless steel weld overlay composition according to claim 18, wherein the Manganese comprises approximately 0.7%.

21. The stainless steel weld overlay composition according to claim 18, wherein the Silicon comprises approximately 0.7%.

22. The stainless steel weld overlay composition according to claim 18, wherein the Chromium comprises approximately 13.0%.

23. The stainless steel weld overlay composition according to claim 18, wherein the Nickel comprises approximately 3.0%.

24. The stainless steel weld overlay composition according to claim 18, wherein the Molybdenum comprises approximately 1.3%.

25. The stainless steel weld overlay composition according to claim 18, wherein the Titanium and the Niobium comprise approximately 2.2%.

26. The stainless steel weld overlay composition according to claim 18, wherein the Vanadium comprises approximately 0.4%.

27. A stainless steel weld overlay having a matrix with a bulk composition comprising, by percent mass:

approximately 0.5% Carbon;

between approximately 0.1% and approximately 2.0% Manganese;

between approximately 0.1% and approximately 1.5% Silicon;

between approximately 11.0% and approximately 18.0% Chromium;

less than approximately 6.0% Nickel;

between approximately 0.1% and approximately 2.5% Molybdenum;

the elements of both Titanium and Niobium in an amount between approximately 0.5% and approximately 8.0%;

greater than 0% and less than approximately 0.15%-Nitrogen; and between approximately 0.05% and approximately 2.0% Vanadium;

wherein both second phase Titanium Carbide and second phase Niobium Carbide precipitates are incorporated in the stainless steel;

wherein the composition is adjusted such that the Carbon content in the matrix is at or below approximately 10% of the bulk Carbon content, the balance being tied up as carbides of Titanium and Niobium.

28. The stainless steel weld overlay composition according to claim 27, wherein the Titanium and the Niobium comprise approximately 2.2%.

29. The stainless steel weld overlay composition according to claim 27, wherein the Chromium comprises approximately 13.0%.

* * * * *